United States Patent [19]

Rejc

[11] Patent Number: 4,547,760

[45] Date of Patent: Oct. 15, 1985

[54] THERMOSTAT FOR REFRIGERATORS WITH A CONSTANT SWITCHING-ON AND ADJUSTABLE SWITCHING-OFF TEMPERATURE

[75] Inventor: Danilo Rejc, Cerkno, Yugoslavia

[73] Assignee: Eta Cerkno, Cerkno, Yugoslavia

[21] Appl. No.: 628,876

[22] Filed: Jul. 9, 1984

[30] Foreign Application Priority Data

Jul. 8, 1983 [YU] Yugoslavia ..... 1543/83

[51] Int. Cl.[4] ..... H01H 37/12; H01H 37/76

[52] U.S. Cl. ..... 337/323; 337/319

[58] Field of Search ..... 337/320, 321, 323, 319, 337/306

[56] References Cited

U.S. PATENT DOCUMENTS 2,762,888 9/1956 Jacobs ..... 337/319

*Primary Examiner*—Harold Broome

*Attorney, Agent, or Firm*—Pollock, Vande Sande & Priddy

[57] ABSTRACT

A thermostat for refrigerators with a constant switching-on and adjustable switching-off temperature uses only one spring, the switching-on and switching-off temperatures being determined by the position of components of the omega switching system.

The switching-on temperature of the thermostat and the difference between the switching-on and switching-off temperatures can be adjusted by means of setting screws, whereas the absolute value of the switching-off temperature can be adjusted by a cam.

3 Claims, 3 Drawing Figures

THERMOSTAT FOR REFRIGERATORS WITH A CONSTANT SWITCHING-ON AND ADJUSTABLE SWITCHING-OFF TEMPERATURE

TECHNICAL FIELD OF THE INVENTION

The invention belongs to the field of autonomous control systems for nonelectric variable quantities-GO5D 23/12.

TECHNICAL PROBLEM TO BE SOLVED

The object of invention is a simply designed refrigerator thermostat comprising a small number of constituents and a reduced number of adjusting components permitting also an automatically controlled adjustment of the thermostat.

PRIOR ART

In present-day refrigerators thermostats are used permitting an automatic defrosting process. Such thermostats are characterized by a constant switching-on temperature whereas the switching-off temperature can be optionally set within the given limits. Known thermostats have a rather complicated mechanical design in which two springs are used, viz. the main and the differential spring. Such a design is quite demanding and expensive. An example of such a thermostat is given in the Yugoslavian patent application P-1862/76.

DESCRIPTION OF THE SOLUTION OF THE TECHNICAL PROBLEM

The technical problem, i.e. thermostat for refrigerators with a constant switching-on and adjustable switching-off temperature, has been solved by a switching system based on a single leaf spring, the changes of the switching-off temperature being achieved by altering the contact clearance in the omega switching system.

The object of the invention will be discussed in more detail further on the basis of the drawing.

Figure 2:
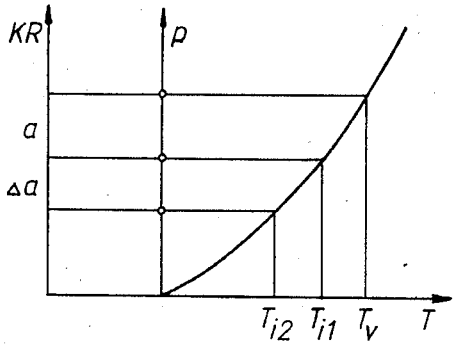
FIG. 2 is a diagram of dependency between the pressure in the pressure bellows and the switching-on or switching-off temperature.
Figure 3:
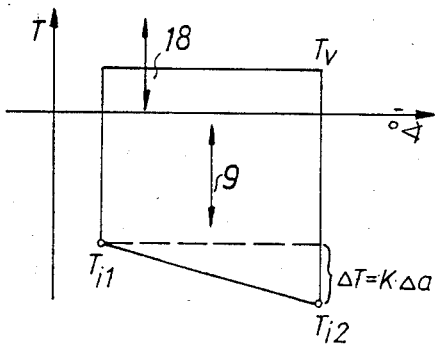
FIG. 3 is a diagram of dependency of switching-on and switching-off temperature of the thermostat upon the position of individual setting elements.

The symbols in the diagrams of FIGS. 2 and 3 have the following meanings:

T = temperature $T_{i1}$ = first switching-off temperature $T_{i2}$ = second switching-off temperature $T_v$ = switching-on temperature $\Delta T$ = difference between first and second switching-off temperature p = pressure of the expansion agent a = minimum contact distance and proportional to $T_v$-$T_{i1}$ wherein $T_v$ is at a minimum and $T_{i1}$ is at a maximum $\Delta a$ = contact difference proportional to $T_{i1}$ and $T_{i2}$ K = a structural constant equal to $$\frac{\Delta T}{\Delta a}$$

KR = contact distance o∢ = rotational position of cam.

DETAILED DESCRIPTION OF THE INVENTION

Figure 1:
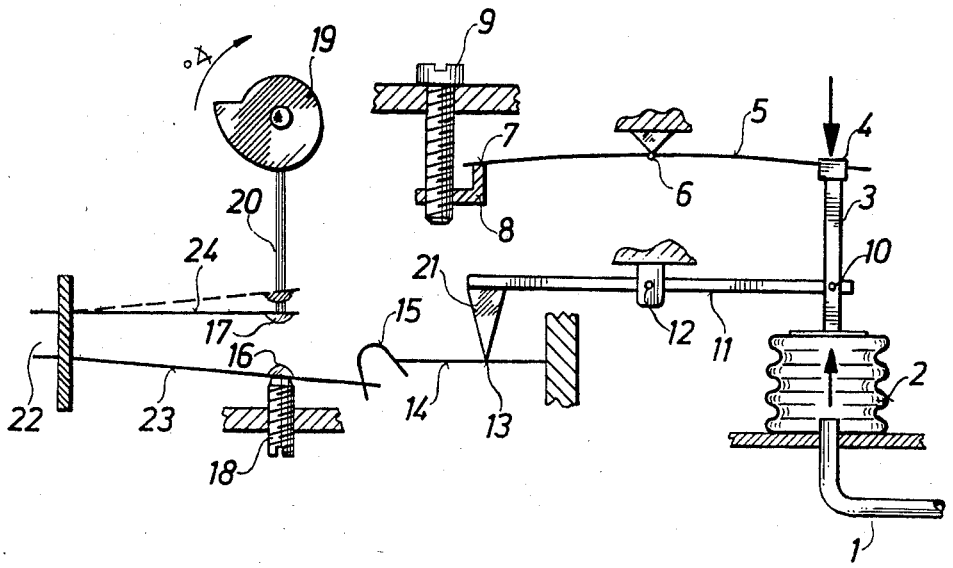
FIG. 1 shows a thermostat according to the invention.

As shown in FIG. 1, the capillary tube 1 feeds an expansion agent from the nonrepresented sensor into the bellows 2 where the agent produces a force $F_m$. This force is transmitted through an intermediate element 3 at the point 4 to an elastic component producing an opposing force $F_v$. In the example shown this elastic element is the leaf spring 5 where the intermediate element 3 exerts a force against one end of the spring 5 which is supported at the hinge 6, whereas its other end at the point 7 presses against the support 8 whose position is adjustable by means of the screw 9.

At the point 10 of the intermediate element 3 is clamped the end of one arm of the two-armed hinge lever 11 which is flexibly fastened on hinge 12 and which at the end of its second arm carries a nonconductive pin 21 against which at the point 13 steadily presses a single-sidedly clamped prestressed spring 14 of the omega switching system; the spring is across the spring 15 coupled to another spring 23 of the omega switching system. At the same time this spring is a support of the first contact 16 of the switch 22, whereas the second contact 17 is fixed coaxially to the first contact 16 on another spring 24. The position of the first contact 16 can be adjusted with the aid of the screw 18, whereas the position of the second contact 17 can be set by means of the cam 19 connected to the spring 24 with the contact 17 across an intermediate element 20, the spring 24 being prestressed in such a way as to press continuously against the element 20. Thus by rotating the cam 19 the relative distance between the contacts 16 and 17 can be varied.

The operation of the thermostat according to the invention depends on the variation of temperature in the nonrepresented sensor. This variation results in an expansion or contraction of the agent passing through the capillary tube 1 into the bellows 2. The thermostat in FIG. 1 is shown at its switching-off working point, i.e. when the agent in the bellows 2 reaches its utmost contraction and the force $F_m$ reaches its lowest value, respectively. By warming up the sensor the agent in the bellows will expand and the force $F_m$ will increase. This force acts across the intermediate element 3 on the spring 5 which reacts with an opposing force $F_v$; at the same time the expansion of the bellows 2 is transmitted across the lever 11 and the pin 21 to the spring 14 of the omega switching system that presses in prestressed manner against pin 21. Raising the temperature of the agent will cause the lever 11 to rotate round the hinge 12, and the pin 21 will increasingly press against the spring 14 at the point 13, pushing it more and more downwards with regard to FIG. 1. When the point of joint of the springs 14 and 15 and the point of joint of the springs 15 and 23 approach to the greatest degree, the spring 23 will jump up in an instant with regard to FIG. 1 causing the contacts 16 and 17 to close. It is obvious that the spring 14 has to be bent more vigorously to fulfil the condition of jumping up if, by unscrewing the setting screw 18, the position of the contact 16 lowers with respect to FIG. 1.

When closed the contacts 16 and 17 will activate the cooling device of the refrigerator causing the agent in the bellows 2 gradually to cool down. The force $F_m$ will decrease, the pin 21 will not press with the same force against the spring 14 as before allowing thereby the spring 14 to move upwards with respect to FIG. 1, i.e. again in the position as shown in FIG. 1. At the given moment, when the conditions discussed above are fulfilled, the spring 23 will jump down causing the contacts 16 and 17 to open. Should the contact 17 with regard to FIG. 1 be in higher position, the spring 14 will have to reach with regard to FIG. 1 a considerably higher position to make the contacts 16 and 17 to open thereby producing the switching action; this will occur when the force $F_m$ is very small permitting the force $F_v$ to press the bellows strongly together.

On the thermostats used with the refrigerators provided with an automatic defroster removing ice from the evaporator, specific requirements in regard to the switching temperatures have to be considered. One of the requirements is that the switching-on temperature $T_v$, which is generally above 0° C., be constant during the operation of the refrigerator, its absolute value being already set by the manufacturer. There has also to be provided the the possibility to adjust the difference between the switching-on temperature $T_v$ and the switching-off temperature $T_i$; the switching-off temperature is generally below 0° C.

The thermostat according to the invention is adjusted by first rotating the cam into a position suited for a given switching-off temperature. Should the cam 19 be rotated in such a manner that the contact 17 approaches at the smallest possible distance to the contact 16 when the switch 22 is in the open position, the switching-off temperature $T_i$ would thus reach its highest relative value so as to correspond to the switching-off temperature $T_{i1}$ shown in the diagram of FIG. 3. By adjusting the tension of the spring 5 using the setting screw 9 the switching-off temperature $T_{i1}$ can be properly set. As shown in FIG. 3, by adjusting the screw the whole characteristic of the thermostat according to the invention is actually moved in vertical direction. On the other hand, by adjusting the setting screw 18 the switching-on temperature $T_v$ can be set to that value which is required for the correct operation of the refrigerator defrosting system in which the thermostat according to the invention is supposed to be used. By rotating the cam 19 in such a way that the distance between the contacts 16 and 17 increases, the switch 22 being in switched-off position—such a position of the leg 24 with the contact 17 is shown in FIG. 1 with dashed line - the switching-off temperature of the thermostat according to the invention is being lowered, reaching at the extreme position of the cam 19 a corresponding value designated in FIG. 3 by $T_{i2}$.

The example of embodiment of the thermostat according to the invention shown in FIG. 1 does not exhaust all the possibilities for a construction thereof. It is obvious to an expert that the force $F_v$ performed by the spring 5 at the point 4 could be replaced, for example, by a force acting directly in the direction of the element 3.

The thermostat according to the invention completely solves the technical problem of reducing the number of components and of simplifying the adjustment procedure. Thus instead of the differential spring used in the known thermostats the omega switching system is used, i.e. the contact system existing in some of its possible forms in every thermostat.

I claim:

1. A thermostat for a refrigeration system for providing a constant switching-on temperature and an adjustable switching-off temperature comprising:

(I) switch-activating means for causing movement in response to a change in temperature in said refrigeration system, said switch-activating means comprising (a) temperature-sensing means in said refrigeration system, said temperature-sensing means including a fluid expansion agent, (b) bellow means (2) for activation by said temperature-sensing means, (c) fluid conduit means (1) interconnecting the interior of said bellow means (2) with said temperature-sensing means, (d) force-transmitting means (3) for resisting force exerted within said bellows (2), and (e) adjustable force exerting means (5, 6, 7, 8) coupled to said force transmitting means (3), (II) switching means comprising (a) first electrical contact means (16) for a switch (22) mounted on first spring means (23), (b) second electrical contact means (17) mounted on second spring means (24), (c) means (18, 19) for separately adjusting the position of each of said contact means (16, 17) with respect to each other, and (III) means operatively interconnecting said switch activating means with said switching means comprising (a) spring lever means (11) supported at a point intermediate its ends by hinge means (12), connected at one end to said switch activating means to move in response to movement of said bellows (21), and (b) spring means (14, 15) coupling said spring lever means (11) with said switching means.

2. A thermostat according to claim 1 characterized in that the adjustable force exerting means comprises spring means (5) supported between both its ends (4, 7) by hinge means 6, and having one of its ends (4) operatively connected to said force transmitting means (3), the other end (7) held in place by support means (8) and adjustment means (9) coupled to said support means (8).

3. A thermostat according to claim 1 characterized in that one of the contacts (17) in said switching means is coupled by prestressed means (20) against a means for adjusting (19) the position of said contact (17).

* * * * *